US009669290B2

(12) United States Patent
Reid

(10) Patent No.: US 9,669,290 B2
(45) Date of Patent: Jun. 6, 2017

(54) BOARD FOR STRATEGIC GAME

(71) Applicant: Perrin Isaac Reid, Apex, NC (US)

(72) Inventor: Perrin Isaac Reid, Apex, NC (US)

( * ) Notice: Subject to any disclaimer, the term of this patent is extended or adjusted under 35 U.S.C. 154(b) by 0 days.

(21) Appl. No.: 14/512,599

(22) Filed: Oct. 13, 2014

(65) Prior Publication Data

US 2015/0028543 A1 Jan. 29, 2015

Related U.S. Application Data

(63) Continuation-in-part of application No. 13/314,247, filed on Dec. 8, 2011, now abandoned.

(51) Int. Cl.
*A63F 3/00* (2006.01)
*A63F 3/02* (2006.01)

(52) U.S. Cl.
CPC ..... *A63F 3/02* (2013.01); *A63F 3/00261* (2013.01); *A63F 3/00697* (2013.01); *A63F 2003/00716* (2013.01)

(58) Field of Classification Search
CPC ..... A63F 3/00261; A63F 3/00697; A63F 2003/00716; A63F 3/02
USPC ..... 273/255, 260, 261
See application file for complete search history.

(56) References Cited

U.S. PATENT DOCUMENTS

| | | | | |
|---|---|---|---|---|
| 2,064,229 | A | 12/1936 | Amster | |
| 3,524,648 | A * | 8/1970 | Nilan | A63F 3/0423 273/153 R |
| 3,588,114 | A * | 6/1971 | Vogel | 273/260 |
| 3,610,626 | A | 10/1971 | Nolte | |
| 3,844,563 | A * | 10/1974 | Isaac | 273/260 |
| 3,915,456 | A | 10/1975 | Ackerman | |
| 5,820,126 | A | 10/1998 | Moore | |
| 6,981,700 | B2 | 1/2006 | Syed et al. | |
| 7,090,218 | B2 | 8/2006 | Yamazaki | |
| 7,677,570 | B2 | 3/2010 | Hohenstein et al. | |
| 2009/0144799 | A1 | 6/2009 | Simske | |
| 2010/0148438 | A1 | 6/2010 | Amos | |
| 2011/0037224 | A1 | 2/2011 | McKay | |

* cited by examiner

*Primary Examiner* — Vishu Mendiratta
(74) *Attorney, Agent, or Firm* — James G. Passé; Passé Intellectual Property, LLC

(57) ABSTRACT

The present invention dates to a board game in which a three piece rivalry system allows for interaction of player pieces in a battle simulation type game.

3 Claims, 3 Drawing Sheets

BOARD FOR STRATEGIC GAME

This application is a continuation-in-part of U.S. non-provisional application Ser. No. 13/314,247 filed on Dec. 8, 2011 and is incorporated in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to strategic games and, more particularly, to strategic games played on a gridded board.

Description of Related Art

There are a very large number of strategic board games (that is, a game played on some form of a game board) that are on the market today. They each offer unique approaches to gaming and the manner of play. Many have an extraordinarily long history, such as chess, checkers, and go. Many of them are played on the familiar grid-type board and variations of the chess/checkerboard are common in games.

Checkers involves pieces that are all the same, with simplistic moves and a limited number of variables. The game is simple to learn and play, but because of the simplicity of move limitations, it does not offer a great variety of strategic play. Chess, on the other hand, involves a large number of different pieces, each with its own move limitations, and infinite move play combinations, leading to a difficult learning curve and extremely complex games which can require hours and hours to play and years to begin to even attempt to master.

BRIEF SUMMARY OF THE INVENTION

The present invention is a board game played on a grid playing board wherein the game is based on players moving and capturing pieces based on a three piece type rivalry system, and on sizes of stacks of playing pieces compared to an opponent's stack of pieces. It comprises a specialized board with certain spaces unplayable.

Accordingly, in one embodiment the present invention relates to a game board and playing pieces for playing a board game for two players consisting of:

a) stackable game pieces consisting of 24 game pieces for each player, the pieces for each player divided into three visually different types of stackable game pieces, eight of each type being visually identical wherein each of the game pieces has a bottom designed to sit on a flat tile.

b) a square grid game play board consisting of 9 tiles long by 9 tiles wide having an opposite side assigned to each player, each side having a plurality of starting tiles and having a home area comprising a center nine tiles of the game board with each of a corner four tiles of the center nine tiles is constructed as an impassable tile by shaping them such that game pieces cannot sit on the impassable tiles, the remaining tiles on the board assigned as flat passable tiles, the passable tiles between the impassable tiles assigned as doorway tiles

DETAILED DESCRIPTION OF THE INVENTION

Figure 1C:
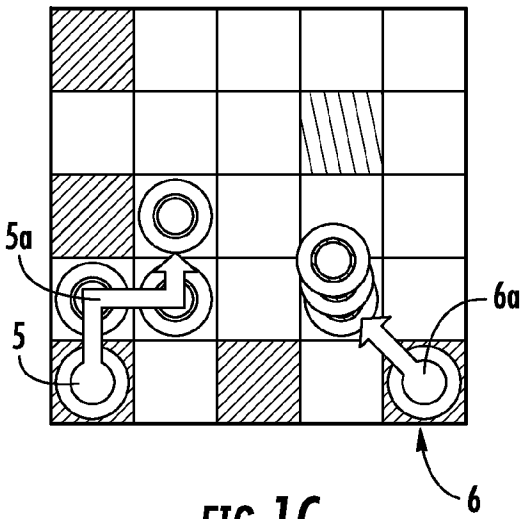
FIGS. 1*a*, 1*b*, and 1*c* depict examples of movement of game pieces of the present game.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The term "about" means ±10 percent.

The term "essentially" means ±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

The game disclosed herein in one embodiment is named Wae~Owasu and is a board game that employs strategic defense and capture. It is played by two players (which also would include two teams, the teams comprising a player).

A "square grid board" refers to a board for a game with squares (tiles) on it like chess or checkers wherein the board is divided into two sides with equal number of squares on each side designed for placing the player's pieces. The passable tiles are constructed as having flat bottoms while the impassable tiles are constructed such that player's flat bottomed game pieces will not sit on them. The board itself can be arranged in a square or rectangular pattern wherein the length and width in terms of the number of tiles on a side are the same or different. In one embodiment, the board is 9 tiles wide by 9 tiles long with a total of 81 tiles in the board. The players would sit on opposite sides of the board during play, and player's pieces would begin on the respective player's sides, but as noted further herein, they may move about the board during play. The players would be assigned to opposing sides of the grid during play.

The "home area" in the present game refers to the center 9 tiles (squares) of the board. In one embodiment, the home is referred to as the "temple". The center nine tiles form a square, three tiles by three tiles grid, with the corner four squares assigned as impassible tiles, that is, squares where a player cannot place their pieces or move onto during game play. The impassable tiles are physically constructed such that playing pieces will not rest or sit on that square. That can be done by physically making the tile not flat, such as by creating a 3-D surface that will not accommodate the flat bottom of a playing piece which is designed to be placed on a flat tile, e.g. a pyramid shape, depression, both, raised or lowered surfaces, and the like. The remaining squares are assigned as passable tiles that a player may place their game pieces on during play subject to other rules outlined herein and they are all flat tiles. In the formation of the home area, there is a single passable tile in between any two impassible tiles. The four tiles in between any two horizontal or vertical pair of impassible tiles are designated doorway tiles and the center tile of the home area (diagonal between any pair of impassible tiles) is designated another passable tile. In one embodiment, the impassible tiles are marked or colored differently than other tiles so they can easily be identified in addition to their 3-D shape.

Each player is assigned "three different types of stackable game pieces". That is, the pieces are capable of being stacked one on top of another to form towers of 2 or more game pieces: they are designed to sit on flat tiles and not sit on impassable tiles. For example, checkers pieces which are round and essentially flat (though they can be patterned in the center) can stack one on top of another. An infinite number could be stacked for this style of stackable piece. In one embodiment, towers or a stack cannot be greater than 4 playing pieces tall. The pieces could be other shapes with flat surfaces which could stack, but could also stack by using locking features (designed to snap together or the like though not entirely flat). Stackable pieces of any shape are within the skill in the art. Each player's pieces are of "three different types" meaning they are marked or otherwise identifiable as both the player's pieces and one of three different pieces for that play. Therefore, in one embodiment, one player's pieces are black with green, blue, or black markings identifying them as the player playing black and his different pieces identified by one of the three colors. The other player might have brown pieces with green, blue, or black markings identifying that player or the brown player. If colors are not desired, markings or different shapes (e.g. round, triangle, square) could be utilized. Only playing pieces of each type will be stacked on each other. For example, green will be stacked on green, blue on blue, but black won't be stacked on green, thus the player's pieces could be shaped differently as long as each type is stackable on like types. Each player, while they will have pieces assigned to them, will each have the same three types of pieces that they may play with (e.g., each player will have green, blue, and black type pieces).

The types of pieces are assigned a "rival power relationship", that is, each playing piece type has a power relationship to the other two types of pieces. The relationship is an A>B; B>C; and C>A type relationship for determining relative strength. For example, the power relationship can be green>blue; blue>black; and black>green. Thus, in any confrontation the power relationship between the type of pieces is always clear. Since each side has the same three types of pieces, confrontations of piece types in the game will be set as part of the rules. Using the above power relationship as an example, in a game with black and brown players with blue, green, and black types, a brown player's green type piece would be more powerful than a black player's blue type piece. In an embodiment of the present game, there are 24 game pieces for each player with an equal number of each type, i.e. eight of each type for each player.

As used herein a "starting tile" refers to the tiles on each player's respective side of the game board where the pieces start off at the beginning of the game. The starting tiles can be a row of tiles nearest each player in one embodiment, however, where ever designated to start is also contemplated. The starting tiles can be designated on the board, for example, by being colored or marked differently than other tiles in the game. In one embodiment, the starting tiles are every other tile on the row nearest each player (as shown in the figures). When returning, game pieces can start on tiles the same or different than that of the original starting tiles, as designated by the particular rules. In one embodiment, player's pieces reentering the board can start on any peripheral tile on their side of the board, and in other embodiments every other tile (indicated e.g. by different color tile) on their side of the board that is a peripheral (edge) tile.

In one embodiment of the game, a plurality of the pieces determined arbitrarily by the rules are left off the board at the start for earning back on the board by game play. For example, where there are twenty four pieces, four pieces are left off the board for later play. The player's pieces are stacked at least two high in the beginning and, in one embodiment, at least three or four high, wherein each stack of pieces is of the same type. In one embodiment, with twenty four pieces per side, five starting tiles each have four playing pieces of the same type with four pieces of the same type off the board. Other combinations could be envisioned depending on the board size and the number of pieces and starting squares. In one embodiment, only pieces off the board can be brought back into the game.

All the game pieces, regardless of type, will have the same movement capabilities during each player's respective turn. The pieces can move across tiles (in one embodiment, not diagonal, nor access impassable tiles) leaving one playing piece on each tile till there are no pieces left, then no more movement can be made. For example, if there are four pieces on a starting square, up to three more tiles can be occupied by the four pieces, one on the original tile and the three pieces on the three new tiles ending the player's turn.

Player's pieces can take a turn where instead of leaving pieces in a path, they can reverse the process and merge pieces into a stack. For example, where there are four pieces in a row, the player can start with the first one and combine them one tile at a time till there are four pieces on one square as long as different playing piece types are not merged.

Movement during play continues by turn and player's pieces can attack the other player's pieces when confronting identical tiles. The win is based on the power relationship of the pieces, as well as the size (number of playing pieces) the player is using to attack the other player. A more detailed understanding can be seen from the particular example of a game which follows and one skilled in the art could easily apply rules or variations of power and size in view of this explanation and the example and figures herein. An example set of game rules is included in the application IDS and is included herein in its entirety by reference.

The players then take turns moving (laying down pieces), merging pieces, or attacking other pieces. Player's pieces can be taken off the board during a losing attack and can be replaced on the game board during a promotion or conversion. Play would then continue until one player has at least one of their pieces (of any type) on each of the doorway tiles. The pieces in the doorway can be either the same or different type as desired in game play. An example of the game rules is shown in the Wae~Owasu game rules filed in the IDS and included herein by reference.

Each time a player uses more dominant pieces; e.g. green attacking blue; to win a battle against the opponent, in one embodiment, the player may take a playing piece of the same type (e.g. green color) as the victorious type from off the board, if such type is available, increasing the winning player's tower or stack size. This addition is called a promotion. The defeated player's pieces go off the board where they are divided into singles. The larger the tower, the stronger the stack, but in an embodiment the tower cannot exceed 4 playing pieces. A player in an embodiment cannot break up a stack lost in a previous battle to provide singles to use for promotions. Dominant rivals in one embodiment cannot attack less dominant enemy stacks that have 2 or more playing pieces more than the attacker. However, the less dominant pieces can attack the more dominant pieces in such circumstances.

When a less dominant tower captures rival pieces because its stack is 2 or more greater in size, this is called a conversion. The defeated player places their entire defeated stack off the board as is. It cannot be divided into singles unless a further conversion occurs. The winning less dominant player has two reward choices for a conversion. The winning less dominant player may either reclaim from his off the board pieces a number of individual pieces that match the type and number of captured pieces and make an independent (new) stack from them, or the player may break up one off the board stack of two or more back into singles and reclaim one of them. Reclaimed new pieces are placed on either a starting tile or, in one embodiment, on edge tiles not occupied.

A scoring system is used in one embodiment, instead of the winner being whoever occupied the 4 entrance way, points can also be assigned for each piece the player has, and the one with the highest score wins. Points can also be assigned for occupying center tiles or other positions.

Figure 1B:
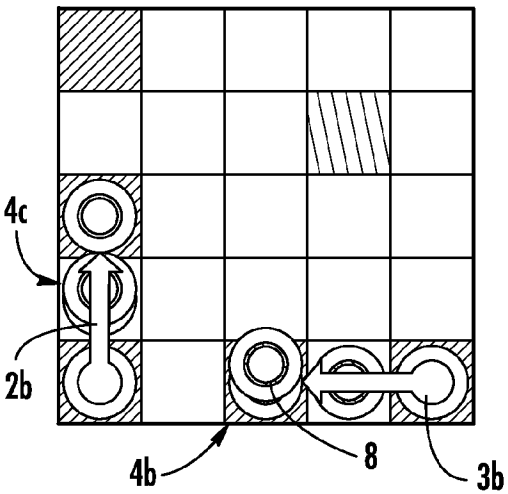
Figure 1A:
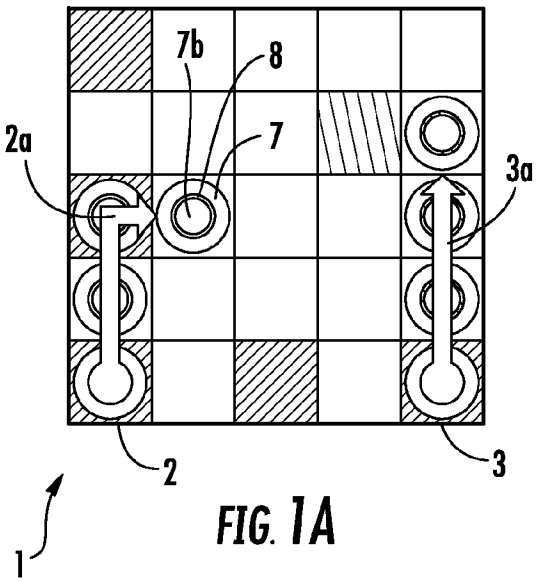

Now referring to the figures. FIGS. 1*a* and 1*b* depict examples of movement of the present game while FIG. 1*c* depicts an impermissible move of diagonal movement. In FIG. 1*a*, playing pieces having flat bottoms for sitting on flat tiles have outer ring 7 and center ring 7*b* to indicate a player's color pieces. Middle rings 8 indicate the dominance color (e.g. blue, green, or black). In FIG. 1*a* the corner of grid board 1 has starting tiles designated as darker tiles 2 and 3. Prior to this view the player has started with four stacked tiles on each of tile 2 and tile 3. The stack on 2 has moved via arrow 2*a* and left a total of four playing pieces on four tiles, two tiles up and one over. The four tiles starting on tile 3 have moved via arrow 3*a* leaving four tiles in a straight row.

FIG. 1*b* depicts that not all the pieces need to be moved on each turn. That is, starting with four pieces, a player does not need to occupy four tiles, rather a player can move one, two, or three tiles leaving one, two, or three pieces on the landing tile as depicted by arrows 2*b* and 3*b*. In each example, there are two player's pieces left on a tile moved over (tile 4*c* and tile 4*b*.)

In FIG. 1*c* a permissible move is depicted starting from tile 5 wherein arrow 5*a* depicts four starting pieces moving one up one over and one up movement. The movement starting from tile 6 indicated by arrow 6*a* in the diagonal is considered impermissible. Pieces could be moved in reverse of a permissible move to merge them into a stack. When merging, it is not permissible to leave pieces behind on a tile the merging stack moved over. All pieces on a tile a merging stack crosses must become part of the merging stack.

Figure 2B:
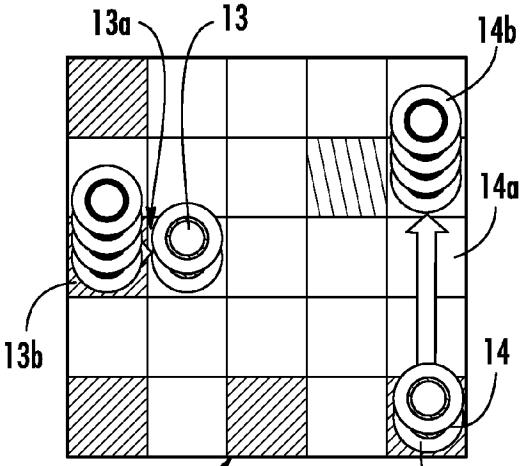
FIGS. 2*a* and 2*b* depict permissible attacking moves which again can be horizontal or vertical on the grid of the playing board but not directly diagonal.
Figure 2A:
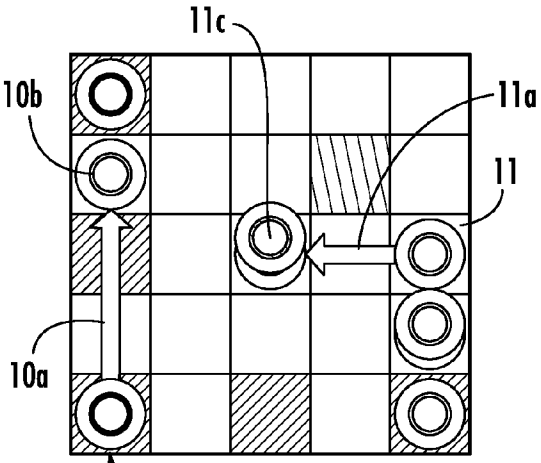

FIGS. 2*a* and 2*b* depict permissible attacking moves, which again can be horizontal or vertical on the grid of the playing board, but not directly diagonal. Attacking pieces that are dominant based on the rival system may move from one tile any number of tiles to attack rival pieces of the opponent as long as movement is only horizontal or vertical and the less dominant attacked pieces do not have two or more individual pieces more in their stacks than the attacking pieces have in their stacks. Players cannot attack or jump over other pieces. If the attacking pieces are not a rival, it can only attack pieces one tile over and which are smaller (less pieces in a stack) than the attacker. In FIG. 2*a* player piece 10 attacks via path 10*a* opponent piece 10*b*. This is permissible because based on the rival system piece 10 is dominant to piece 10*b*. Player piece 11, which is one piece, attacks via route 11*a* stack of two opponent pieces 11*c*. FIG. 2*b* uses two identical sets of different stacks to depict how, under one circumstance, an attack move is permissible, but when the roles are reversed, the move is then impermissible. For the first part of this example, even though player stack 13*b* is less dominant based on the rival system, it also has two or more individual pieces in it than the opponent stack 13 which then allows it to attack stack 13 via route 13*a*. In the opposite of this example, player stack 14, which is dominant based on the rival system, cannot attack the less dominant opponent stack 14*b* via route 14*a* because stack 14*b* has two or more individual pieces in it than stack 14. Opponents who are successfully attacked based on rival system and size are removed from the playing game board. At the same time, if there are pieces left of the players off the board, the player winning the battle can reclaim a number of his off the board pieces based on the piece he used to win the battle and the piece his opponent just lost.

Figure 3:
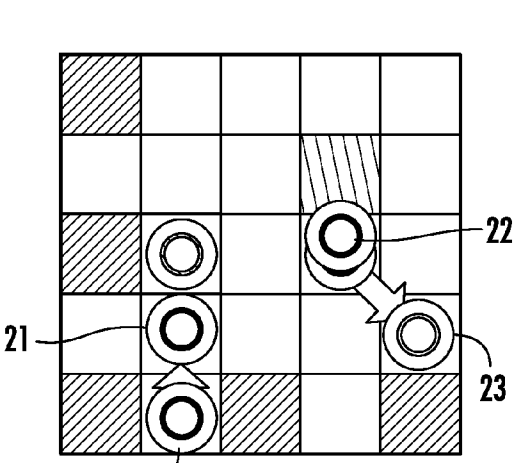
FIG. 3 depicts actions that are not permissible such as attacking a piece of the same color and moving or attacking diagonally.

In one embodiment of the invention, there is shown impermissible moves as in FIG. 3. In this rule it is impermissible, when a player uses the same type of playing piece 20 as opponent's playing piece 21. In one embodiment that is impermissible, the playing pieces 22 cannot affect player 23 in a diagonal manner.

Figure 4:
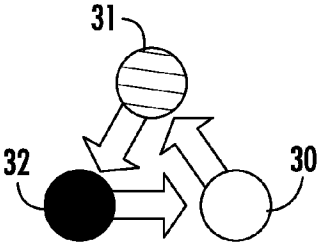
FIG. 4 depicts the rivalry system of the game.

FIG. 4 shows an example of the rivalry system with playing pieces green 30 being greater than blue pieces 31, being greater than black pieces 32, but black pieces 32 being greater rival power than green pieces 30.

Figure 5:
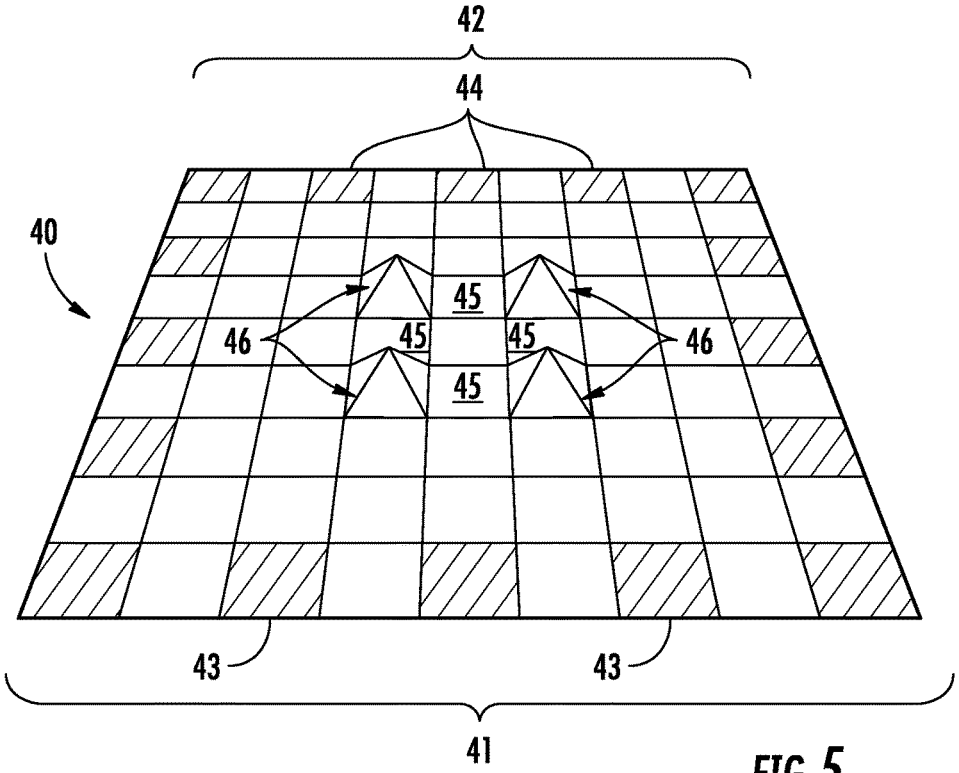
FIG. 5 depicts and embodiment of the game board and depicts pyramid shaped impassable tiles.

FIG. 5 depicts an embodiment of the grid board 40 of the present invention. The grid board 40 has eighty one squares and has one player's side 41 and the other player's side 42. The dark peripheral squares 43 and 44 represent starting squares of each player's pieces. The home (or Temple) squares are the nine tiles bounded by impassible tiles 46 which are in the shape of a pyramid making it impossible to place a stackable piece on the impassable tiles 46 while tiles 45 are the doorways, which if occupied by at least one piece by a single player, wins the game for that player.

Figure 6:
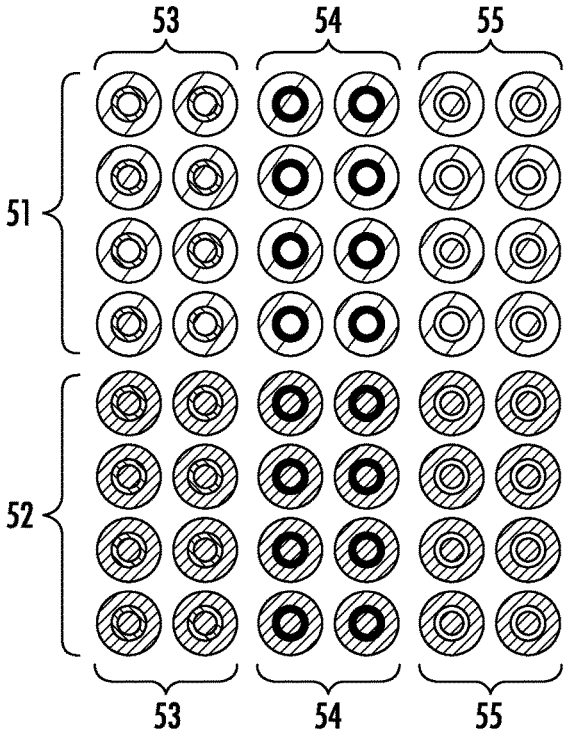
FIG. 6 depicts an example of stackable game pieces each having a flat bottom.

In FIG. 6 there are shown twenty four playing pieces 51 and 52 for each player. For example, the pieces could be black for pieces 51 and brown for pieces 52 columns 53, 54, and 55 respectively represent the eight pieces of each type (color in this example) blue 53, black 54, and green 55 indicating piece type with equal amount if each piece type controlled by each player. Each piece has a bottom designed to sit on flat tiles and they will not sit/rest on impassable tiles, e.g. will slide off of a pyramid slope.

Now giving the rules for a specific embodiment of the game utilizing the game embodiment of the figures. Each of two players begin the game with eight singles of each piece type, blue, green, and black, for a total of twenty four pieces for each player. The player creates from these pieces two stacks of four for each color type. The players take turns placing one of their stacks on each of the five starting tiles along their edge of the board until all five tiles are filled with a stack of the player's four pieces. This leaves one stack all of one color which is moved off the board and divided into singles which can be utilized when necessary for bringing pieces back into the game by reclaiming them.

Each player takes turns moving one of their stacks either horizontally, vertically, or a combination of the two, but not diagonally, by taking all the pieces in a stack but one and leaving the selected pieces in a path of singles, stacks of multiple pieces, or any combination of the two. At least one game piece must be left on each tile moved over. It should be noted the path does not need to be straight, only continuous. A stack that has not moved from its starting tile cannot be attacked. Alternatively, two or more continuous tiles having pieces on them along a pathway may merge the pieces into one stack at either end of the path. Merger can only be of one color, i.e. piece types cannot be mixed in stacks. Therefore in play, a player picks up a playing piece at one tile and stacks it on the next, and the next in the path in one direction, till the final continuous tile desired (where one wants to stop) is reached. There is no limit to the stack size when merging other than the limit of player's pieces of that color. A player's turn then consists of either moving and laying out pieces, merging, or attacking on the player's turn, but only one of these can be done. Singles cannot move except to attack (and only by rivalry dominance) or to merge.

Players attack by moving the pieces on a tile horizontally or vertically from one tile to capture an opponent's pieces on another tile. The ability to attack, and thus capture an opponent's pieces, is determined by size and rivalry criteria. A dominant rival may move any distance across the board to attack an opponent who is a less dominant rival. A dominant color will win an attack as long as the opponent is no more than one piece larger than the attacker. If the attacked piece is not a less dominant rival then a player can only attack a player's pieces that are in a tile horizontally or vertically next to the player and that has less pieces in their stack. Same color stacks and singles cannot attack each other. The losing player in the attack takes the pieces off the board. The winning player can reclaim a piece of the same color as the attacking piece and place it on the winning stack. However, stacks cannot be made larger than four in this manner. One takes the singles from the "off the board" location, but if none are available, none can be used on the board. When a player uses a stack of less dominant pieces by the rival system that is larger by at least two or more individual pieces to attack its opponent, it is called a conversion (again see FIG. 2*b*) and instead of promoting the stack, he converts the rival pieces captured to his side, off the board to utilize as his own. At this point of play, the converting player may either reclaim an equal number or smaller number of individual pieces that are the same color as the captured stack, or the converting player may instead alternatively choose to break up a stack he had previously lost to a conversion made by his opponent, dividing it back into individual single pieces and reclaim one of those. The reclaimed piece is then placed on any one of the starting places not occupied by a stack or a path on the converting player's side, where it remains till moved. Note, additional starting spaces on the side of the board which could not be used at the beginning of the game can now be utilized for this purpose. The game ends after the end of a player's turn when there is at least one player's piece (in one embodiment only one piece) on each of the doorway tiles, or when the opponent forfeits.

In one optional embodiment, play may also include points to further introduce strategy and also to help decide stalemates where a final outcome is impossible. For example, players might get points for each single piece their opponent lost during play, not including those parts of an attack that are captured. Players might also get points for each single piece that is part of a stack and get ten points for each stack of a certain (four or greater) stack.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A game board and playing pieces for playing a board game for two players consisting of:

a) game pieces consisting of 48 game pieces, the pieces divided into six groups of eight stackable pieces, wherein the pieces in each group are identical to one another and are different from the pieces in each of the other groups; wherein each of the game pieces has a bottom designed to sit on a flat tile; and b) a 9 by 9 grid game play board consisting of 81 playing tiles, the 81 playing tiles having 32 peripheral edge tiles; 9 center tiles formed in a 3 by 3 grid and having 4 corner tiles; and 40 other tiles, the 81 tiles consisting of:

i. 16 visually identical peripheral flat edge tiles positioned every other peripheral edge tile;

ii. 4 visually identical corner tiles positioned at the four corner tiles of the 9 center tiles 3 by 3 grid, wherein the tiles are physically constructed on the game board, rising above the surface of the game board creating a three dimensional surface such that the playing pieces' flat bottoms will not rest or sit on the corner tile; and iii. 61 visually identical remaining flat tiles, wherein each of the 16 visually identical edge tiles, 4 visually identical corner tiles and 56 visually identical remaining tiles are visually different from one another.

2. The game board according to claim 1 wherein the 4 visually identical corner tiles positioned at the four corners tiles of the 9 center tiles 3 by 3 grid are pyramidal shaped.

3. The game board according to claim 1 wherein the 4 visually identical corner tiles have a surface that is other than horizontal.

* * * * *